United States Patent [19]

Lynn et al.

[11] 4,209,313

[45] Jun. 24, 1980

[54] METHOD FOR CONTROLLING NOXIOUS GASES FORMED DURING GRANULATION OF MOLTEN SLAG

[75] Inventors: John D. Lynn, Center Valley, Pa.; Gerald N. Carrick, Baltimore, Md.

[73] Assignee: Bethlehem Steel Corporation, Bethlehem, Pa.

[21] Appl. No.: 459

[22] Filed: Jan. 2, 1979

[51] Int. Cl.[2] ..... C04B 5/02

[52] U.S. Cl. ..... 65/19; 65/141

[58] Field of Search ..... 65/19, 20, 141; 75/24

[56] References Cited

U.S. PATENT DOCUMENTS

| | | | |
|---|---|---|---|
| 1,916,402 | 7/1933 | Allen | 65/19 |
| 3,607,168 | 9/1971 | Grady | 65/141 X |
| 3,738,820 | 6/1973 | Osborne et al. | 65/19 |
| 3,823,010 | 9/1974 | Tobias | 65/19 X |
| 3,833,354 | 9/1974 | Thummler et al. | 65/19 X |
| 3,856,495 | 12/1974 | Faxton | 65/19 |
| 3,897,231 | 7/1975 | Massey et al. | 65/19 |
| 3,900,304 | 8/1975 | Rehmus | 65/19 |
| 3,912,487 | 10/1975 | Sharanov et al. | 65/19 X |
| 4,046,542 | 9/1977 | Schmidt | 65/19 |
| 4,115,089 | 9/1978 | Metz et al. | 65/19 |

OTHER PUBLICATIONS

Rengstorff et al., Battelle Memorial Institute Report to AISI Task Force on Hydrogen Sulfide Formation from Blast Furnace Slags, Oct. 31, 1967.

Bosselmann et al., "New Slag Granulation and Dewatering System . . .", *Consistent Iron,* The Metals Society, 1975, pp. 91–95.

Dauzats, "Influence of Granulating Conditions on the Reactivity of Molten Slag", *Circulaire d'Informations → Techniques, Centre de Documentation Siderurgique,* Mar. 1969.

Kaplan Battelle Memorial Institute Final Report to AISI on the Formation of Gases from Blast Furnace Slags, Dec. 10, 1970.

Sharanov et al., "Slag Granulation at A 5,000 M³ Blast Furnace", *Stal*(8), (BISI translation 16622) 1977, pp. 692–695.

Javelle, "Granulation of Blast Furnace Slags", *Circulaire d'Informations Techniques Centre de Documentation Siderurgique,* Mar. 1969.

*Primary Examiner*—Richard V. Fisher

*Attorney, Agent, or Firm*—Joseph J. O'Keefe; Charles A. Wilkinson; John S. Simitz

[57] ABSTRACT

Molten blast furnace slag is quenched by a volume of water divided into two streams. The first stream is directed downwardly against the slag while the second stream is directed horizontally against the slag. The molten slag is broken down into relatively fine sand-like granules which are kept submerged in the water. The vapors formed during granulation are substantially free of detectable $SO_2$ and the $H_2S$ formed and vented to the atmosphere is insufficient to be a detriment to the surrounding environment.

5 Claims, 1 Drawing Figure

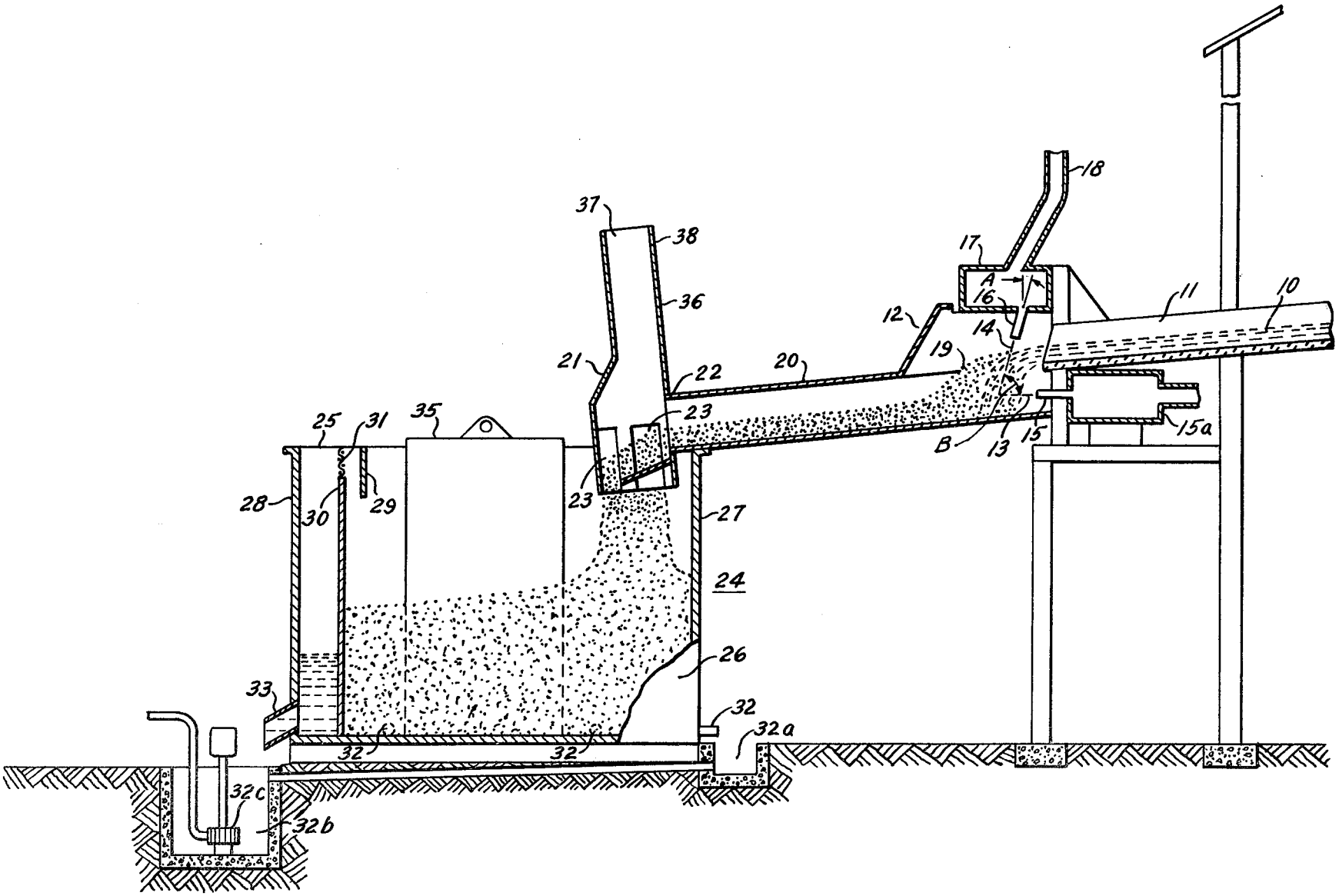
10
11
15a
18
17
A
16
14
15
13
B
19
12
20
22
23
38
36
37
21
23
27
24
26
32
32a
32
32
35
31
29
25
30
28
33
32b
32c

METHOD FOR CONTROLLING NOXIOUS GASES FORMED DURING GRANULATION OF MOLTEN SLAG

BACKGROUND OF THE INVENTION

This invention is directed to a method for controlling the emission of noxious gases during the granulation of molten slags and in particular to the control of the emission of $SO_2$ and $H_2S$ during the granulation of molten blast furnace slags to prepare such slags for use as portland blast furnace slag cement.

Processes for granulating molten slags and in particular blast furnace slags to produce a product which can be used to produce portland blast furnace slag cement are known. In these processes, the molten slag is contacted with water. Large quantities of steam and other gases are evolved. The molten slags contain sulfur as sulfides in various amounts. The sulfides react with hydrogen ($H_2$) and water ($H_2O$) during granulation and as a result a gas, $H_2S$ (hydrogen sulfide) is formed and mixed with the vapors.

Apparently, $H_2S$ in the vapors is then oxidized by the oxygen in the atmosphere to form $SO_2$ (sulfur dioxide) and $H_2O$ (water or steam). A portion of the $H_2S$ in the vapors is not reacted, hence the vapors from the granulation of molten slags discharged to the atmosphere contain both $H_2S$ and $SO_2$. Because $H_2S$ and $SO_2$ are both noxious and corrosive, the amounts of $H_2S$ and $SO_2$ which can be discharged into the atmosphere are strictly regulated.

Processes in which the granulation of the slag and the cooling of the slag after granulation are performed in a closed system to prevent the venting of noxious $SO_2$ and $H_2S$ gases to the atmosphere have been devised.

One such closed process is described in U.S. Pat. No. 3,738,820 to F. Osborne, et al entitled "Method and Apparatus for the Processing of Molten Slag." In the process, the molten slag is introduced into an enclosure and is sprayed with water in the enclosure. The granulated slag is transported and cooled on conveyors in the enclosure. As the slag is transported, it and the noxious gases are sprayed with water until all evolution of gases ceases. It is contended that the noxious gases are thus removed from the vapors and are thus not vented to the atmosphere. Scrubbing the vapors with water may succeed in the removal of such gases from the vapors discharged into the atmosphere, however, the emission of the noxious gases is not suppressed. The apparatus is bulky and complicated. The process is time consuming and hence expensive thereby increasing the cost of producing granulated blast furnace slag.

Another process which attempts to overcome the increased costs of granulating slags in a partially closed system is described in U.S. Pat. No. 4,046,542 issued to Kees J. Schmidt entitled "Method and Device for Granulating Blast Furnace Slag." The patent contends that molten blast furnace slag is granulated by a powerful spraying system in an open explosion room. The granulated slag is transported from the explosion room to a dewatering tank provided with a dewatering bed. The process does not suppress the formation of the noxious gases $SO_2$ and $H_2S$. The apparatus does provide a means for venting the vapors containing the noxious gases, $H_2S$ and $SO_2$ into the atmosphere through a high chimney above the level of the workers so that the noxious fumes are not a nuisance to the workers or surrounding inhabitants. While the apparatus may achieve the purpose for which is was intended, namely to discharge the noxious vapors above the level of the workers, the basic problem of suppressing the formation of $SO_2$ and $H_2S$ gases and venting quantities of the gases which are too small to be obnoxious to the surroundings are not solved. Noxious vapors are still discharged into the atmosphere and as such may pollute the environment.

It is an object of this invention to provide a method for controlling the emission of $SO_2$ and $H_2S$ during the granulation of blast furnace slag wherein the gases formed during granulation are substantially free from any detectable amounts of $SO_2$ and the amount of $H_2S$ vented to the atmosphere is not objectionable.

SUMMARY OF THE INVENTION

In accordance with this invention, there is provided a method for controlling the emission of noxious gases, $SO_2$ and $H_2S$ during the granulation of slag, particularly blast furnace slag for use as portland blast furnace slag cement wherein the gases formed during granulation which are vented to the atmosphere are substantially free from any detectable $SO_2$ and the amount of $H_2S$ vented to the atmosphere is not objectionable.

In the method of the invention, a molten solid stream of slag is sprayed with a volume of high pressure water to substantially instantaneously quench and break-up the slag into relatively fine sand-like glassy granules which are submerged in water to form a slag-water slurry. The slurry is discharged into a dewatering tank. The volume of water is divided into two streams directed against the molten slag. One volume is sprayed onto the slag from a horizontal position. The second volume is sprayed from an overhead position slightly inclined from the vertical. The streams of water meet at a common area on the slag. The ratio of the volume of water to the volume of slag to be granulated may be between about 7 and 11 to 1. About 10 to 20 volume percent of the total volume of water sprayed on the slag is sprayed downwardly onto the slag through a plurality of pipes positioned above the slag stream across the entire width of the slag stream. The pipes are inclined at an angle of between about 10° to 20° to the vertical. The remainder or about 80 to 90 volume percent of the total volume of water is sprayed through a plurality of pipes and nozzles positioned horizontally beneath the slag and across the entire width of the slag stream.

About 96 to 98 weight percent of the slag is glass, i.e. no crystallization has taken place in the slag. The slag has a bulk density of between about 961 and 1282 kilograms per cubic meter (60 and 80 pounds per cubic foot). The average size of the granules of slag is between $-6.4$ mm ($-\frac{1}{4}$ inch) and $+100$ mesh.

The vapors discharged into the atmosphere are substantially free from any detectable $SO_2$ and contain a quantity of $H_2S$ which is unobjectionable to the surroundings. The water separated from the slag granules is substantially free from $H_2S$ and $SO_2$. The water may be recycled in the system after being cooled or may be discharged into environmental surface waters after cooling and clarification.

FIGURE OF THE INVENTION

The FIGURE of the invention is a diagrammatic representation of the apparatus used in the method of the invention.

PREFERRED EMBODIMENT OF THE INVENTION

In a detailed description of the method of the invention, molten blast furnace slag is collected in an enlarged slag runner in the cast house floor. When a sufficiently large pool of slag has been accumulated, a feed hole of a predetermined size is opened in one of the sidewalls of the slag runner to allow the molten slag to be fed to a granulator by means of a slag feed runner.

Turning now to the FIGURE of the invention, which is shown by way of example only, molten slag 10 collected in a pool in a slag runner on the blast furnace casting floor (not shown) flows down slag feed runner 11 and is allowed to fall freely by gravity into an open box or granulator 12. As the molten slag 10 flows into the granulator 12, two streams of water 13 and 14 are impinged onto the slag 10. One stream of water 13 is supplied through a plurality of pipes 15 mounted on a header box 15*a* and extend substantially horizontally beneath the slag feed runner 11. The second stream of water 14 is supplied through a plurality of pipes 16 extending downwardly from a header or water box 17 positioned a spaced distance atop the granulator 12. Water is supplied to the water box 17 by means of feed pipe 18. The pipes 16 are disposed at an angle A between about 10° and 20° and preferably about 15° with the vertical. The streams of water 13 and 14 are impinged substantially simultaneously on the same area of the slag 10. The included angle B formed by the streams of water 13 and 14 is between about 80° and 70° and is preferably about 75°. The water is sprayed from the pipes at a pressure which is between about 1.1 to 4.2 kilograms per square centimeter (20 to 60 pounds per square inch gage) and preferably 2.1 kilograms per square centimeter (30 pounds per square inch gage). The water sprays substantially instantaneously break-up the molten slag into relatively fine sand-like granules 19 which are quenched and submerged in the water forming a slag granules-water slurry. The granules are substantially instantaneously solidified. Because the slag is substantially instantaneously cooled and solidified the granules of slag do not have an opportunity to crystallize. Hence, the granules are substantially glass. The glass content of the granules is at least 95 weight percent and preferably at least 98 weight percent, i.e. very little if any crystalline formation has occurred. The slurry is transported through a tubular member 20 which is a downwardly inclined part of the granulator 12 to a distribution box 21 fixedly attached to the front and lower end 22 of the member 20. The high pressure water acts as a vehicle in transporting the slag granules. The slurry is discharged from member 20 into the distributing box 21 and is distributed by a device (not shown) through one or more openings 23 in the bottom of the distributing box 21 to a generally rectangular dewatering tank 24.

The dewatering tank 24 has two long sidewalls 25 and 26 and two short walls 27 and 28. A skimmer plate 29 extending between walls 25 and 26 and parallel to walls 27 and 28 is fixedly positioned in spaced relationship to the wall 28 as shown. The skimmer plate 29 retards the flow of granules toward the wall 28. A weir 30 and an upwardly extending screen 31 fastened to the top of the weir 30 extend between and are attached to walls 25 and 26 at predetermined distances from the skimmer plate 29 and wall 28. The weir 30 and screen 31 are parallel to wall 28. Excess water flows over the weir 30 and through screen 31 and is discharged from the tank 24. The screen 31 prevents granules of slag from flowing out of the tank 24 with the overflow water. A plurality of drain pipes 32 are provided at the bottom of sidewalls 25 and 26. The drain pipes feed a drainage ditch 32*a* which transports the water to a sump 32. The water is pumped from the sump 32*b* by pump 32*c* to a holding reservoir (not shown) and is cooled to about 70° F. prior to being discharged into environmental waters. Wall 28 is provided with a large drain 33 by which water is removed from the dewatering tank 24. After a sufficient amount of dewatered granulated slag is collected in the tank 24, a movable portion 35 of end wall 25 is raised and the granulated slag removed by appropriate equipment, for example a front end loader or a conveyor.

During granulation copious quantities of vapors are formed. The vapors are primarily steam but do include quantities of the gas $H_2S$. The vapors and gas thus formed pass through the tubular member 20. As the granules pass through the tubular member 20, the granules continue to cool and continue to give off vapors, substantially all of which are steam. The vapors pass from the tubular member 20 to the distributing box 21 and are discharged from the distributing box to a relatively short chimney 36 through an opening 37 in the top 38 of the distributing box 21. The vapors are discharged into the atmosphere through the relatively short chimney 37. If any $SO_2$ gas is produced during granulation, the quantities of such gas are so minute that they are not detectable by appropriate instruments (not shown) placed in the short chimney 36.

It has been found that the slag can be fed to the granulating box at rates as low as about 0.45 metric ton per hour (0.5 tons per hour) and more than about 2.7 metric tons per hour (3 tons per hour) without producing intolerable amounts of $H_2S$ or detectable amounts of $SO_2$. However, it has been found that at feed rates of less than about 0.9 metric ton per hour (one ton per hour), the molten slag tends to freeze in the slag feed runner and the process of granulation becomes difficult to control. Additionally, the rate of production of granulated slag is uneconomically low. At slag feed rates of more than about 2.7 metric tons per hour (3 tons per hour), the quality of the slag, that is the amount of glass produced in the granulated slag may be reduced to below 95 weight percent and the production of light aggregates or floaters becomes excessive. Therefore, the slag feed rate should be between about 0.9 and 2.7 metric tons per hour (1 and 3 tons per hour) and preferably about 1.8 metric tons per hour (2 tons per hour) for most efficient operation. The molten slag is sprayed with a total volume of water which is divided into two streams. A first stream of water containing between about 10 and 20 volume percent and preferably about 15 volume percent of the total volume of water, is directed downwardly through pipes which are inclined at an angle between about 10° and 20° and preferably about 15° to the vertical. This volume of water keeps the slag granules immersed in water. The second stream of water containing between about 80 to 90 volume percent and preferably about 85 volume percent of the total volume of water is directed substantially horizontally against the slag. The water in both streams is sprayed at a pressure of between about 1.1 to 4.2 kilograms per square centimeter (15 to 60 pounds per square inch) and preferably about 1.4 to 2.5 kilograms per square centimeter (20 to 35 pounds per square inch gage). The water is sprayed through a plurality of nozzles attached to the water pipes whereby the water attains a discharge velocity of between about 13.7 to 27.4 meters per second (45 to 90 feet per second) and preferably between about 16.8 to 21.3 meters per second (55 to 70 feet per second). The high discharge velocity of the water from the top sprays keeps the sand-like granules of slag substantially completely submerged in the water thereby effectively quenching them and preventing any substantial crystallization from occurring. Apparently, at pressures near and above the high side of the broad range, the action between the slag and water is so violent that the granules are not restrained sufficiently to remain in the water and crystallization can occur resulting in slag which is as low as 90 weight percent glass. Slags of this content are not acceptable for use as portland blast furnace slag cement. As the solid stream of molten slag falls from the slag runner, the slag is substantially instantaneously broken-up into relatively fine sand-like granules having a size range between $-6.4$ mm ($-\frac{1}{4}$ inch), $+100$ sieve size (United States Standard Sieve Series) which are substantially instantaneously solidified. When we use the term "solid stream of slag" we mean an unbroken rope-like stream of molten slag. The slag is substantially instantaneously cooled to a temperature below the crystallization temperature of the slag thus crystallization of the slag is effectively suppressed. As a result, the crystallization of the slag is reduced to a minimum and the granules are at least 95 and preferably at least 98 weight percent glass.

The first stream of water is sprayed by means of a plurality of pipes, i.e. at least two, depending downwardly from a header or water box fixedly attached to a suitable framework, for example, structural steel fixed at a predetermined spaced distance above the granulator. The number of pipes required to spray the molten slag is dependent upon the width of the slag stream. A wide stream may require three, four or even more pipes whereas a narrow stream may require only two pipes to spray the entire stream of slag. The second stream of water is sprayed by means of a plurality of pipes, i.e. at least two, and preferably about seven or more pipes positioned substantially horizontally beneath the slag feed runner as noted previously. The number of pipes required is dependent upon the width of the stream of molten slag as described above. The ratio of the total volume of water sprayed onto the slag, that is the sum of the volume of water sprayed through both systems of pipes to the volume of slag which is to be granulated is between 7 and 11 to 1 and is preferably 9 to 1. The ratio may be higher than 11 to 1 but this has been found to be wasteful of water.

Unexpectedly, we have found that the vapors and gases formed during granulation and while the slag granules are cooling during transport in the tubular member, contain steam and a quantity of $H_2S$ but are substantially free from detectable $SO_2$ when vented to the atmosphere. It is postulated that the sudden formation of relatively fine solidified sand-like granules which are kept submerged in the water by the discharge velocity of the water, substantially suppresses the reaction between sulfides in the slag and elements in the atmosphere thereby effectively suppressing the formation of $H_2S$. Decreasing the amount of $H_2S$ formed during granulation decreases the potential for the oxidation of $H_2S$ by the oxygen in the atmosphere and the subsequent substantial elimination of the formation of $SO_2$ in the vapors of granulation. While the foregoing is a logical theoretical explanation of the surprising reduction of $SO_2$ and $H_2S$ in granulation vapors, we do not wish to be held to this theory.

In a specific example of the invention, molten slag having a chemical composition as follows:

| | |
|---|---|
| Silica ($SiO_2$) | 35% |
| Alumina ($Al_2O_3$) | 10% |
| Lime (CaO) | 39% |
| Magnesia (MgO) | 11% |
| Carbon (Free) | 0.1% |
| Iron | ~1% |
| Sulfides | ~1% |

was collected in a slag runner of a blast furnace cast house floor. The molten slag was fed through an orifice having a 15.24 cm (6 inch) diameter in one wall of the slag runner. The orifice allowed a slag feed rate of 1.81 metric tons (2 tons per minute) to a granulator through the slag feed runner. As the molten slag fell by gravity from the end of the slag feed runner into the granulator, it was sprayed with 16,277 liters per minute (4300 gallons per minute) of water at a pressure of 2.812 Kgs/cm$^2$ (40 pounds per square inch gage) (2.04 Atm) at a water temperature of 24° C. (75° F.). The water was sprayed onto the slag in two streams. The first stream of 1790 liters per minute (473 gallons per minute) was sprayed downwardly from above the slag runner at a discharge velocity of 21.3 meters per second (70 feet per second) through three nozzles positioned 15° to the vertical. The second stream of 14,525 liters per minute (3,837 gallons per minute) was sprayed at a discharge velocity of 21.3 meters per second (70 feet per second) through seven nozzles positioned horizontally below the slag feed runner. The included angle formed by the junction of the first and second streams of water on the slag was 75°. The sand-like granules and water slurry formed during granulation was transported from the granulating box to a dewatering tank through the granulator tube and a distributing box fastened to the end of the granulator tube. The slurry was discharged into a dewatering tank through openings in the bottom of the distributing box. The vapors formed during granulation also passed downwardly through the granulator tube and were discharged upwardly through an opening in the top of the distributing box to a chimney extending vertically upwardly from the distributing box. The vapors were tested by means of a sample probe extending through a wall of the chimney and into the vertical axis of the chimney at a position about one third of the distance between the top and bottom of the chimney. The samples of the vapors were analyzed by means of a gas chromatograph with a flame photometric detector and mass spectrometer. The vapors were found to be substantially free of detectable $SO_2$ fumes and contained an average concentration of 900 ppm or 54.5 grams of $H_2S$ per metric ton (0.12 pound of $H_2S$ per ton) of slag at an average measured flow rate in the chimney of 47.3 dry cubic meters per minute (1670 (DSCFM).

The water used to spray the slag and the water in the granulated slag-water slurry were analyzed. The results are shown below:

| Dissolved Solids (mg/l) | Spray Water | Water In Slag Slurry |
|---|---|---|
| TDS (total dissolved solids) | 4207 | 4238 |
| SS (suspended solids) | 93 | 134 |
| pH | 7.5 | 7.5 |
| $H_2O$ (Hardness) | 770 | 770 |
| $Na^+$ | 1025d | 1038 |
| $Mg^{++}$ | 96 | 92 |
| $Ca^{++}$ | 72.6 | 86 |
| Fe | 2.2 | 2.0 |
| $SO_4^{-}$ (*sulfate*) | 300 | 300 |
| $Cl^-$ | 2050 | 2150 |
| $CN^-$ | .04 | .029 |
| $CO_3^{--}$ (carbonate) | 0 | 0 |

The granulated slag-water slurry contained 10 weight percent granules of slag and 90 weight percent water. The particles of slag were less than 6.4 mm (¼ inch) in diameter on the average. The granules had a bulk density of 1121.4 kilograms per cubic meter (70 pounds per cubic foot). The sudden chilling of the slag resulted in the formation of sand-like granules of slag which were about 2% crystalline and 98% amorphous or glass.

While we have shown an "open" or "pass-through" system in which the water used to quench the slag is taken from environmental surface waters; is used to quench the molten slag; is cooled and clarified, and is then returned to the environmental surface waters, it is within the scope of this invention to use a "closed" system in which the water used to quench the molten slag is recycled in the system, i.e. used several times before being discharged into environmental waters. Since, the solubility of $H_2S$ decreases with increasing water temperature and the efficiency of forming glass in the slag is also decreased with increasing temperature, i.e. the hotter the water the less glass formed in the slag. The water must be cooled prior to being recycled in the system. The temperature of the quench water should not exceed 60° C. (140° F.) and preferably will be within the range of 21° C. to 43° C. (70° F. to 110° F.). The water is cooled as much as possible preferably to within a few degrees of the temperature of the environmental waters prior to being discharged therein.

We claim:

1. In a method for controlling the emission of $SO_2$ and $H_2S$ vapors formed during granulation of molten slag wherein a volume of high pressure water is sprayed onto the surface of the molten slag in a granulating box, the ratio of the volume of water to the volume of molten slag treated being between about 7 and 11 to 1, whereby the molten slag is broken up into relatively fine sand-like granules of slag and a slag granules-water slurry is formed, the slag granules being characterized by having a size consist of −6.4 mm (−¼ inch) and being substantially free from crystallization, the vapors emitted to the atmosphere being substantially free from $SO_2$, the improvement comprising:

(a) spraying between about 80 and 90 volume percent of the high pressure water substantially horizontally across the surface of the molten slag and between about 10 and 20 volume percent of the high pressure water at an angle downwardly on top of the surface of the molten slag, the water being sprayed at a pressure of between about 1.1 and 4.2 kilograms per square centimeter and a velocity between about 13.7 and 27.4 meters per second at essentially the same area of the slag to substantially instantaneously solidify the granules of slag and submerge the granules of slag in the water thereby forming a slag granules-water slurry, (b) transporting the slag granules-water slurry and vapors formed in step (a) to a distributing box, and (c) discharging the slag granules-water slurry to a dewatering tank and the vapors to the atmosphere.

2. The method as claimed in claim 1 wherein the granules of slag formed in step (a) are between 95 and 98 weight percent glass.

3. The method as claimed in claim 1 wherein the granules of slag formed in step (a) are at least 98 weight percent glass.

4. The method as claimed in claim 1 wherein the water sprayed onto the molten slag in step (a) has a velocity of between about 16.8 and 21.3 meters per second.

5. The method as claimed in claim 1 wherein the water sprayed from atop the slag is sprayed at an angle of between about 10° to 20° to the vertical.

* * * * *